United States Patent [19]

Whiteside

[11] 4,395,317

[45] Jul. 26, 1983

[54] WETTING TENSION TREATING APPARATUS AND METHOD

[76] Inventor: Darwin L. Whiteside, Rte. 2, Box 85 N., Royse City, Tex. 75089

[21] Appl. No.: 339,403

[22] Filed: Jan. 15, 1982

[51] Int. Cl.[3] ..... B01K 1/00; H01T 19/04

[52] U.S. Cl. ..... 204/165; 204/212; 250/325; 422/186.04

[58] Field of Search ..... 204/212, 164, 165; 250/325, 531

[56] References Cited

U.S. PATENT DOCUMENTS

| | | | |
|---|---|---|---|
| 3,419,489 | 12/1968 | Delaney | 250/325 |
| 3,514,393 | 5/1970 | Eisby | 204/312 |
| 3,754,117 | 8/1973 | Walter | 219/383 |
| 3,890,504 | 6/1975 | Pendleton et al. | 250/325 |
| 3,973,132 | 8/1976 | Prinz et al. | 250/531 |
| 4,002,907 | 1/1977 | Kalwar | 250/325 |
| 4,051,044 | 9/1977 | Sorenson | 250/531 |
| 4,152,747 | 5/1979 | Fisher | 361/229 |
| 4,281,247 | 7/1981 | Schuster | 250/324 |

*Primary Examiner*—John F. Niebling

*Attorney, Agent, or Firm*—Hubbard, Thurman, Turner & Tucker

[57] ABSTRACT

A method and apparatus for the treatment of thin sheeting by subjecting said sheeting to a corona discharge. Two elongated electrodes are provided in a fixed spatial relationship. The first electrode is coated with a dielectric material and electrically grounded. The second electrode is machined to include a plurality of intersecting furrows which define a plurality of mesa structures, each having at least one acute angle corner. An electrical potential is applied to the second electrode and the sheeting material is then transported between the two electrodes. The mesa structures machined into the surface of the second electrode serve to enhance the amount of corona created by a given amount of electrical potential.

8 Claims, 3 Drawing Figures

WETTING TENSION TREATING APPARATUS AND METHOD

BACKGROUND OF THE INVENTION

This invention relates in general to apparatus for the treatment of thin sheeting to improve ink adhesion and in particular to apparatus which utilizes high voltage corona discharge to treat said sheeting.

It is well known in the prior art that surface treatment of various types of plastic films by exposure to high voltage corona discharge will improve the adhesion characteristics of the film and result in an improved reception and retention of printing inks.

Known corona discharge devices typically include a stationary electrode connected to a high voltage source and a grounded roller electrode about which the plastic film is wrapped. The roller electrode is usually a steel or aluminum core cylinder which is coated with an insulating dielectric material.

Various methods and apparatus have been utilized in attempts to enhance the reliability and consistency of the treatment obtained by such devices, including the utilization of diverse shapes of electrodes such as knife edged electrodes or ridged cylinder electrodes.

SUMMARY OF THE INVENTION

It is therefore one object of the present invention to provide an improved corona discharge treatment apparatus.

It is another object of the present invention to provide an improved corona discharge treatment apparatus which is compatible with existing treatment apparatus.

It is yet another object of the present invention to provide an improved corona discharge treatment apparatus which produces higher levels of treatment with identical electrical power requirements.

The foregoing and other objects of the present invention are accomplished as is now disclosed. Two elongated electrodes are provided in a fixed spatial relationship. The first electrode is coated with a dielectric material and electrically grounded. The second electrode is machined to include a plurality of intersecting furrows which define a plurality of mesa structures, each having at least one acute angle corner. An electrical potential is applied to the second electrode and the sheeting material is then transported between the two electrodes. The mesa structures machined into the surface of the second electrode serve to enhance the amount of corona created by a given amount of electrical potential.

BRIEF DESCRIPTION OF THE DRAWINGS

The novel features believed characteristic of the invention are set forth in the appended claims. The invention itself; however, as well as a preferred mode of use, further objects and advantages thereof, will best be understood by reference to the following detailed description of an illustrative embodiment when read in conjunction with the accompanying drawings, wherein:

DETAILED DESCRIPTION OF THE INVENTION

Figure 1:
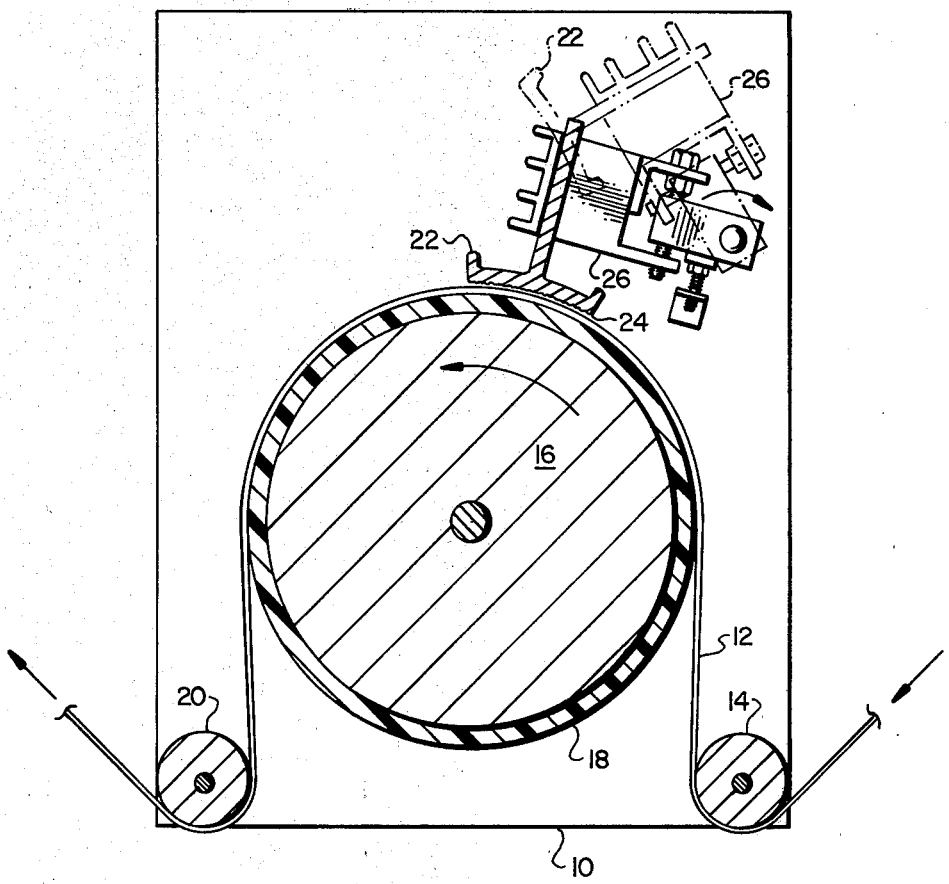
FIG. 1 is a side sectional view depicting the major components of the improved corona discharge treatment apparatus of the present invention.

With reference now to the figures and in particular with reference to FIG. 1, there is depicted a side sectional view of the major components of an improved corona discharge treatment apparatus 10. A web of plastic film or sheeting 12 is fed into treatment apparatus 10 and wrapped around idler roller 14. The web is then wrapped around roller electrode 16, which is driven by the web, or power driven to correspond to web speed. Roller electrode 16, in the embodiment depicted, is constructed of steel or aluminum and is coated with a dielectric material 18 that serves as an insulator between the core of roller electrode 16 and the corona discharge. Dielectric material 18 may consist of an epoxy material, silicon rubber, hypalon rubber or glass.

Web 12, after wrapping around roller electrode 16, is wrapped around idler roller 20 and fed out of treatment apparatus 10. Those skilled in the art will appreciate that in applications in which it is desired to treat both sides of web 12, a second roller electrode may be employed and web 12 may be wrapped in an "S" shaped path and treated on each side by a separate treatment electrode.

In the depicted embodiment, only one side of web 12 is treated as it passes through the gap between roller electrode 16 and treatment electrode 22. Treatment electrode 22 is mounted in a fixed spatial relationship with roller electrode 16 and includes a concave arcuate surface 24. Arcuate surface 24 is mounted approximately parallel to the surface of dielectric material 18. Mounting bracket 26 is utilized to maintain the fixed spatial relationship between treatment electrode 22 and roller electrode 16 and may be utilized to pivot treatment electrode 22 up and away from roller electrode 16 in order to permit web 12 to be initially wrapped around roller electrode 16. A high voltage potential is applied to treatment electrode 22 and a capacitive corona discharge circuit is established between roller electrode 16 and treatment electrode 22 across dielectric material 18, web 12 and the air gap present under arcuate surface 24.

Again, those skilled in the art will appreciate that in apparatus for the treatment of conductive foils and the like, a slightly different arrangement of electrodes is utilized. In such applications two roller electrodes are typically utilized. A first roller electrode is coated with dielectric material and coupled to a high voltage potential. A second, uncoated metal roller is electrically grounded. The conductive foil is wrapped around the grounded uncoated metal roller and a similar corona discharge circuit is established.

An important feature of the present invention is the treatment of the surface of the uncoated metal electrode in treatment apparatus 10. In the depicted embodiment, this treatment is applied to arcuate surface 24 of treatment electrode 22; however, in the conductive foil treatment apparatus discussed above, the treatment is applied to the external surface of the coated electrode roller.

Figure 2:
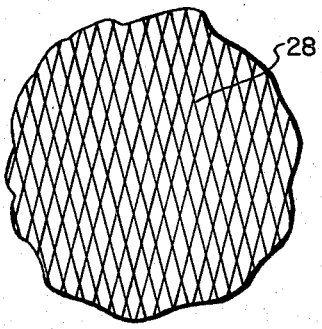
FIG. 2 is an enlarged plan view of the surface of one electrode of the improved corona discharge treatment of the present invention.
Figure 3:
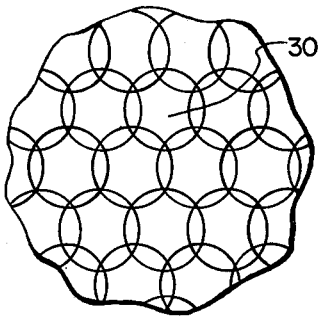
FIG. 3 is an enlarged plan view of another embodiment of the surface of one electrode of the improved corona discharge treatment apparatus of the present invention.

One example of the treatment employed in the present invention is depicted in FIG. 2. FIG. 2 is an enlarged plan view of arcuate surface 24 of treatment electrode 22. As can be seen in FIG. 2, the treatment of arcuate surface 24 consists of machining or scribing a plurality of grooves or furrows into the surface. The furrows machined into arcuate surface 24, as depicted in FIG. 2, consist of two sets of parallel lines which intersect at an acute angle. Thus, the surface of arcuate surface 24 now consists of a plurality of diamond-shaped mesa structures such as the one labeled 28. Experimentation has proven that such mesa structures which are characterized by acute angle corners serve to greatly enhance the corona discharge present at treatment electrode 22. Similarly, as depicted in FIG. 3, an alternate embodiment of the treatment applied to arcuate surface 24 may consist of a plurality of machined or scribed circular or oval grooves. Such a treatment also results in the surface of arcuate surface 24 being covered with a plurality of mesa structures such as the one labelled 30, each having at least one acute angle corner. Upon reference to this specification, those skilled in the art will appreciate that alternating patterns of grooves or furrows may be utilized to enhance the corona discharge effect of treatment electrode 22 by creating mesa structures containing acute angle corners.

Although the invention has been described with reference to a specific embodiment, this description is not meant to be construed in a limiting sense. Various modifications of the disclosed embodiment as well as alternative embodiments of the invention will become apparent to persons skilled in the art upon reference to the description of the invention. It is therefore contemplated that the appended claims will cover any such modifications or embodiments that fall within the true scope of the invention.

What is claimed is:

1. An apparatus for the treatment of thin sheeting by subjecting said sheeting to a corona discharge, said apparatus comprising:

A first elongated electrode;

A second elongated electrode;

means supporting said first and second elongated electrodes in a relationship defining a gap therebetween; and means for passing said sheeting through said gap, said first elongated electrode including an exterior surface disposed near said second elongated electrode, said exterior surface including a plurality of intersecting furrows defining a plurality of mesa structures each having at least one acute angle corner.

2. The apparatus according to claim 1 wherein said second elongated electrode comprises a cylindrical roller electrode.

3. The apparatus according to claim 2 wherein said cylindrical roller electrode includes a dielectric coating.

4. The apparatus according to claim 3 wherein said cylindrical roller electrode is electrically grounded.

5. The apparatus according to claim 2 wherein said first elongated electrode includes an exterior surface comprising a concave arcuate surface substantially parallel to the surface of said cylindrical roller electrode.

6. The apparatus according to claim 1 wherein said plurality of intersecting furrows comprise a first plurality of parallel straight line furrows and a second plurality of parallel straight line furrows each of said second plurality of parallel straight line furrows intersecting said first plurality at an acute angle.

7. The apparatus according to claim 1 wherein said plurality of intersecting furrows comprise a plurality of intersecting circular grooves.

8. A method of treating thin sheeting by subjecting said sheeting to a corona discharge comprising the steps of:

providing an electrically grounded cylindrical electrode;

coating said cylindrical electrode with a dielectric material;

providing an elongated electrode positioned near said cylindrical electrode;

machining the exterior surface of said second electrode with a plurality of intersecting furrows whereby a plurality of mesa structures is defined;

coupling said elongated electrode to an electrical potential; and transporting said sheeting between said cylindrical electrode and said elongated electrode.

* * * * *